United States Patent [19]

Salerno

[11] 4,368,555

[45] Jan. 18, 1983

[54] SLIDING DOOR SAFETY DEVICE

[76] Inventor: Michael T. Salerno, 424A Ramapo Valley Rd., Oakland, N.J. 07436

[21] Appl. No.: 256,017

[22] Filed: Apr. 21, 1981

[51] Int. Cl.[3] ..... E05F 5/04

[52] U.S. Cl. ..... 16/83; 16/86 A

[58] Field of Search ..... 16/82, 83, 86 R, 86 A

[56] References Cited

U.S. PATENT DOCUMENTS

| | | | |
|---|---|---|---|
| 896,242 | 8/1908 | Ralston | 16/83 |
| 2,617,140 | 11/1952 | Desy | 16/86 A |
| 3,800,360 | 4/1974 | Knarreborg | 16/83 |
| 4,028,772 | 6/1977 | Salerno | 16/86 A |
| 4,165,553 | 8/1979 | Salerno | 16/86 A |

*Primary Examiner*—Wm. Carter Reynolds
*Attorney, Agent, or Firm*—Daniel Jay Tick

[57] ABSTRACT

A support device pivotally supports a resilient body on the leading surface of either a door or a sliding door frame in a manner whereby the gravitational force on the body moves the body between a sliding door and the frame. The body is mounted on a rod which is accommodated in a mounting housing. The body is manually movable away from the door and the frame, so that the body is positioned by gravitational force in abutment with the leading surface of the door when the door is closed. This permits the door to be securely closed with its leading edge in abutment with the frame. The body is interposed by gravitational force between the leading edge of the door and the frame when the door is open thereby preventing the door from closing fully by preventing the leading edge of the door from abutting the frame and thus protecting hands from being crushed between the door and the frame. A deactivation preventing device in the housing limits the extent of manual movement of the ball away from the leading edges of the door and the frame to prevent positioning of the ball at a point from which the gravitational force on the ball moves the ball toward the leading surface of the door or the frame rather than between the door and the frame.

5 Claims, 5 Drawing Figures

SLIDING DOOR SAFETY DEVICE

BACKGROUND OF THE INVENTION

The present invention relates to a sliding door safety device. More particularly, the invention relates to a deactivation preventing device for preventing deactivation of a sliding door safety device for a sliding door slidably mounted in a door frame having a track slidably accommodating the door.

People, and especially children, are often injured when they have a hand caught between a sliding door and its frame when they or someone else pushes the door closed and is not aware of the dangerous position of the hand.

My U.S. Pat. No. 4,165,553, granted Aug. 28, 1979 and my copending patent application, Ser. No. 164,083, filed June 30, 1980 disclose sliding door safety devices for preventing the fingers of unsuspecting people, and especially children, from being crushed between the door and the frame of a sliding door when the door is suddenly closed, and for preventing injury to people's hands when a sliding door is suddenly closed, which device is of simple structure and installable with facility and convenience for use with newly installed and old doors, which devices are inexpensive in manufacture and function efficiently, effectively and reliably to prevent a sliding door from closing fully, thereby preventing the hand of an unsuspecting person from being crushed between the door and its frame when the door is suddenly closed.

The sliding door safety devices described in my patent and patent application function due to gravitational force. However, after each activation or operation of the sliding door safety device, a ball must be manually positioned so that it is ready for the next operation or activation. The ball may be manually positioned at a point from which the gravitational force on the ball moves it toward the leading surface of the door or the leading surface of the frame, rather than between the door and the frame, where it must move in order to function properly. If the ball is manually positioned so that the ball will be moved by gravitational force to the leading surface of the door or the leading surface of the frame, rather than between the door and the frame, the sliding door safety device is deactivated and will not function in the desired manner.

The principal object of the invention is to provide a sliding door safety device which includes a deactivation preventing device of simple structure, which is inexpensive in manufacture and prevents deactivation of the sliding door safety device.

An object of the invention is to provide a sliding door safety device having a deactivation preventing device which functions efficiently, effectively and reliably to prevent deactivation of the sliding door safety device by assuring the proper operation of said device all the time.

BRIEF SUMMARY OF THE INVENTION

In accordance with the invention, a sliding door safety device for a sliding door slidably mounted in a door frame having a track slidably accommodating the door, the door having a leading edge which abuts the frame when the door is closed and a leading surface in the area of the leading edge, the frame having a leading surface which is next-adjacent the leading surface of the door when the door is closed, comprises a resilient ball and support means pivotally supporting the resilient ball on one of the leading surface of the door and the leading surface of the frame in a manner whereby the gravitational force on the ball moves the ball between the door and the frame, the ball being manually movable away from the door and the frame, so that the ball is positioned by gravitational force in abutment with the leading surface of one of the frame and the door when the door is closed thereby permitting the door to be securely closed with its leading edge in abutment with the frame, and is interposed by gravitational force between the leading edge of the door and the frame when the door is open thereby preventing the door from closing fully by preventing the leading edge of the door from abutting the frame and thus protecting hands from being crushed between the door and the frame. The support means includes deactivation preventing means for limiting the extent of manual movement of the ball away from the leading edges of the door and the frame to prevent positioning of the ball at a point from which the gravitational force on the ball moves the ball to one of the leading surface of the door and the leading surface of the frame, rather than between the leading edges of the door and the frame.

The support means comprises a rod of predetermined diameter having a linear part and spaced opposite first and second ends, and mounting means pivotally mounting the rod at an acute angle with one of the leading surface of the door and the leading surface of the frame in a manner whereby the ball is rotatable in an operating plane perpendicular to the linear part and at an acute angle with one of the leading surface of the door and the frame. The mounting means comprises a housing affixed to one of the leading surface of the door and the leading surface of the frame. The deactivation preventing means is mounted in the housing.

The linear part of the rod extends for most of its length from the first end and is bent in the area of its second end in a manner whereby the second end is spaced at a substantially radial distance from the linear part. The ball is mounted on the second end of the rod. The housing of the mounting means has spaced substantially parallel top and bottom parts extending in planes spaced below and substantially parallel to the operating plane. The top part has a top hole formed therethrough and the bottom part has a bottom hole formed therethrough. The top and bottom holes pivotally accommodate the rod with the first end of the rod passing through the bottom hole and the area of the end of the linear part adjacent the bent area of the rod passing through the top hole and most of the linear part of the rod being in the housing and the bent area of the rod being outside of the housing. The first end of the rod is outside the housing. A bushing in the bottom hole is affixed to the first end of the rod and rotatable therewith for manually rotating the rod to return the ball from a position between the door and the frame to a position at the leading edge of one of the frame and the door.

The bottom hole has a predetermined diameter and the bushing has a finger accommodating portion outside the housing of greater diameter than that of the bottom hole and a securing ring portion inside the housing of greater diameter than that of the bottom hole for retaining the rod in position in the housing. The deactivation preventing means comprises a first lug extending from the ring portion and rotatable therewith and a second lug in the housing in operative proximity with the first lug. The first lug abuts the second lug upon manual rotation of the rod a predetermined rotary angular extent to prevent further rotation of the rod and thereby preventing positioning of the ball at a point from which the gravitational force on the ball moves the ball to one of the leading surface of the door and the leading surface of the frame, rather than between the leading edges of the door and the frame.

The finger accommodating portion of the bushing consists of a knurled knob part for manual rotation of the bushing and the rod and ball. The securing ring portion prevents the bushing and the rod from axial movement more than a predetermined tolerance.

The housing has a side joining the top and bottom parts thereof and the second lug of the deactivation preventing means extends from the side.

The first lug of the deactivation preventing means extends from the securing ring portion in spaced parallel relation with the rod and toward the top part of the housing.

The top hole has a diameter sufficiently greater than the diameter of the rod to accommodate the rod loosely. The bottom hole has a diameter sufficiently greater than the diameter of the bushing to accommodate the bushing loosely.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The sliding door safety device of the invention is described in my copending patent application Ser. No. 164,083, filed June 30, 1980.

Figure 1:
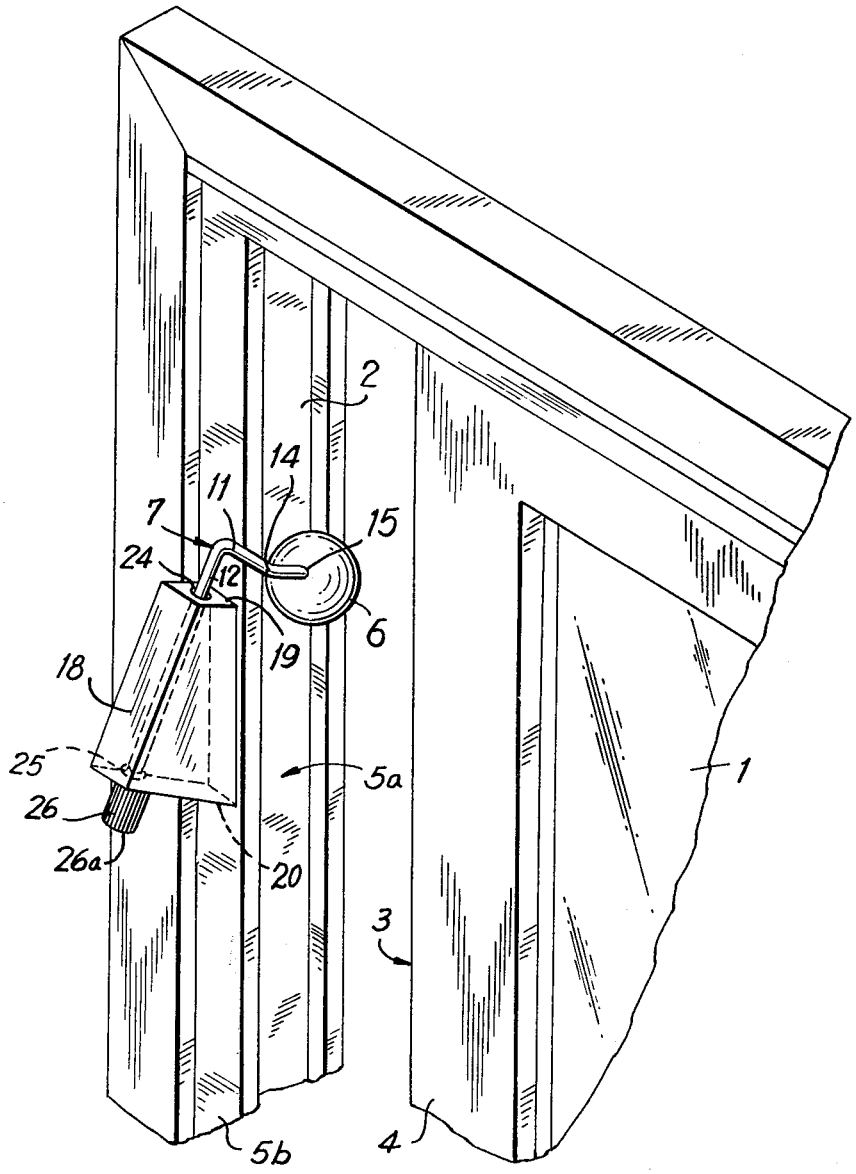
FIG. 1 is a perspective view of a first embodiment of the sliding door safety device of the invention, mounted on a door frame and in operative position.
Figure 2:
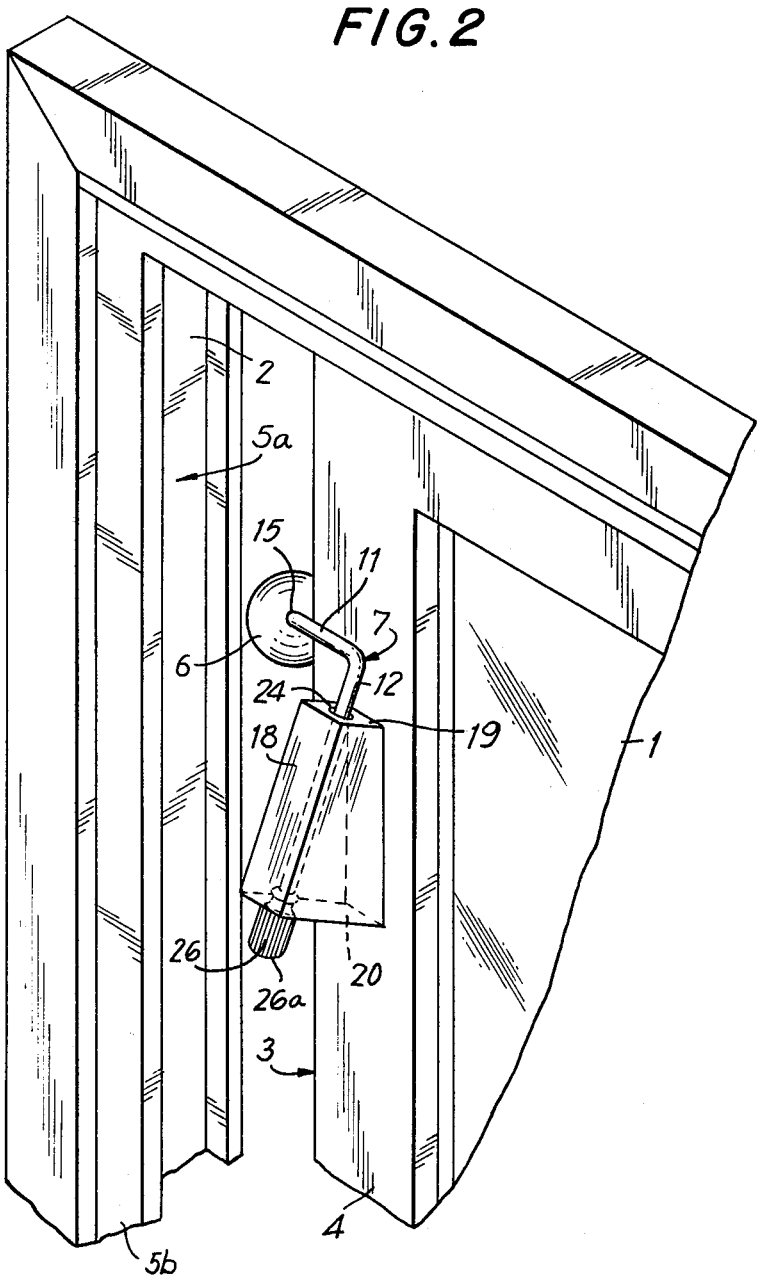
FIG. 2 is a perspective view of the embodiment of the sliding door safety device of FIG. 1, mounted on a door and in operative position.

The sliding door safety device of the invention is for a sliding door 1 (FIGS. 1 and 2) slidably mounted in a door frame 2 (FIGS. 1 and 2) having a track (not shown in the FIGS.) slidably accommodating the door. The door 1 has a leading edge 3, which abuts the frame 2 when said door is closed, and a leading surface 4 in the area of said leading edge, as shown in FIGS. 1 and 2. The frame 2 has a leading edge 5*a* and a leading surface 5*b* (FIGS. 1, 2, 3 and 4) which is next-adjacent the leading surface 4 of the door 1 when said door is closed.

The sliding door safety device of the invention includes a resilient body or ball 6 (FIGS. 1 to 4) of any suitable material such as, for example, rubber.

In the device of the invention, a support device pivotally supports the resilient body 6 either on the leading surface 5*b* of the frame 2, as shown in FIG. 1, or on the leading surface 4 of the door 1, as shown in FIG. 2, in a manner whereby the gravitational force on said body moves said body between the door 1 and said frame, as shown in FIGS. 1 and 2. The body or ball 6 is manually movable away from the door 1 and the frame 2, so that said body is positioned by gravitational force in abutment with the leading surface 4 of said door when said door is closed, thereby permitting said door to be securely closed with its leading edge 3 in abutment with the leading edge 5*a* of said frame.

The body 6 is interposed by gravitational force between the leading edge 3 of the door 1 and the frame 2 when said door is open, as shown in FIGS. 1 and 2, thereby preventing said door from closing fully by preventing said leading edge of said door from abutting said frame and thus protecting hands from being crushed between said door and said frame.

Figure 3:
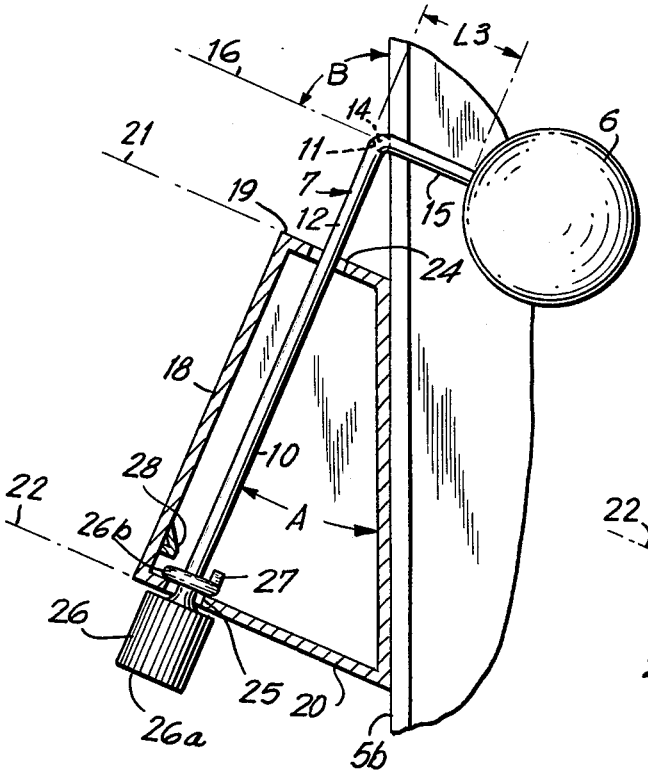
FIG. 3 is a schematic diagram, partly in section, of the embodiment of FIGS. 1 and 2 in operative position.
Figure 4:
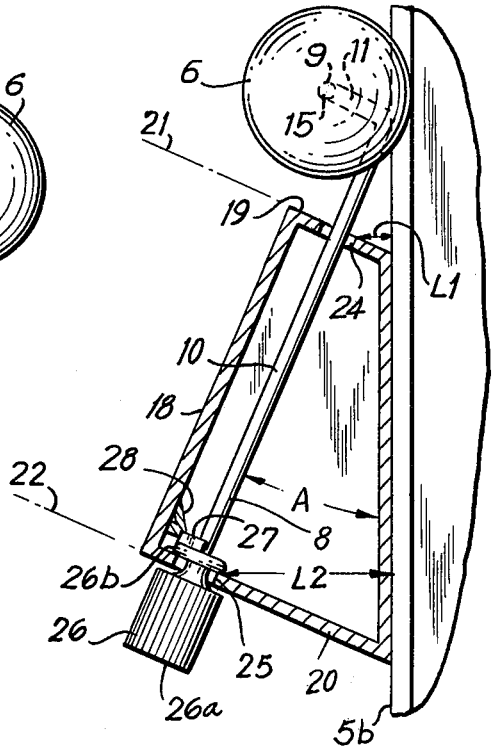
FIG. 4 is a schematic diagram, partly in section, of the embodiment of FIGS. 1 and 2 in an inoperative position.

The support device of the invention comprises a rod 7 (FIGS. 1 to 5) of predetermined diameter having spaced opposite first and second ends 8 and 9, respectively, as shown in FIG. 4. The rod 7 has a linear part 10 (FIGS. 3 and 4) extending for most of its length from the first end 8 thereof. The rod 7 is twice bent in the area of its second end 9 in a manner whereby said second end is spaced at a substantially radial distance from the linear part 10.

The rod 7 of the invention is first bent in the area of its second end 9 at substantially right angles with the linear part 10 of said rod to form a first arm 11 extending from the end 12 of said linear part adjacent the bent area, as shown in FIG. 3. The first arm 11 and the linear part 10 form a first support plane. The rod 7 is bent a second time at the end 14 (FIGS. 1 and 3) of the first arm 11 farthest from the linear part 10 at substantially right angles with said first arm, to form a second arm 15 extending from said end of said first arm, as shown in FIGS. 1 and 2. The first and second arms 11 and 15 form an operating plane 16 (FIG. 3) perpendicular to the first support plane and to the linear part 10. The operating plane 16 is further described hereinafter.

The resilient body or ball 6 is mounted on the second end 9 of the rod 7 by any suitable device and may be fixedly or rotatably mounted on said rod.

A mounting device pivotally mounts the rod 7 at an acute angle A with the leading surface 5*b* of the frame 2, as shown in FIGS. 1, 3 and 4, in a manner whereby the body 6 is rotatable in the operating plane 16. The operating plane 16 is at an acute angle B with the leading surface 5*b* of the frame 2, as shown in FIG. 3. A mounting device pivotally mounts the rod 7 at an acute angle with the leading surface 4 of the door 1, as shown in FIG. 2, in a manner whereby the body 6 is rotated about the operating plane 16, which is at an acute angle with said leading surface.

Figure 5:
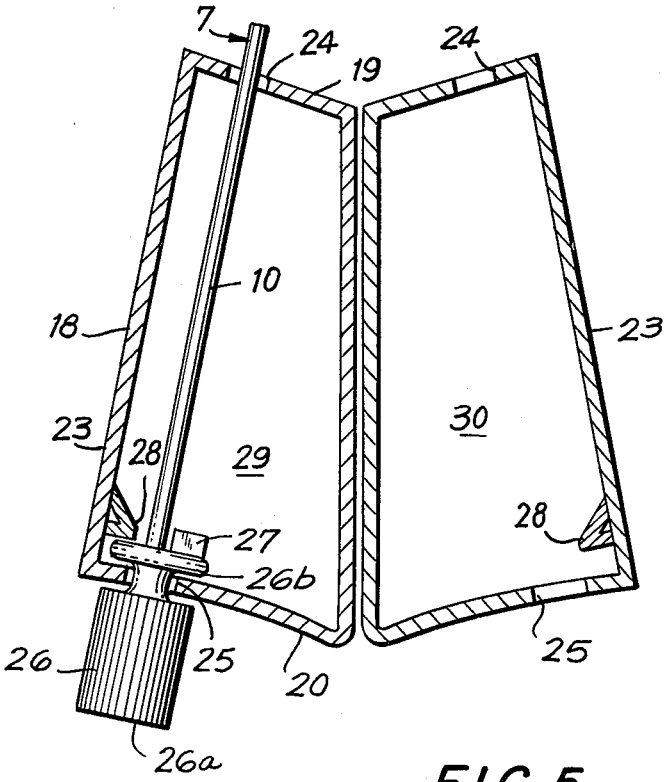
FIG. 5 is a schematic diagram, partly in section, of an embodiment of the housing of the sliding door safety device of the invention, showing the deactivation preventing device of the invention.

The mounting device comprises a housing 18 (FIGS. 1 to 5) affixed to the leading surface 5*b* of the frame 2, as shown in FIGS. 1, 3 and 4, or to the leading surface 4 of the door 1, as shown in FIG. 2. The housing 18 has spaced substantially parallel top and bottom parts 19 and 20, respectively, extending in planes 21 and 22, respectively, spaced below and substantially parallel to the operating plane 16, as shown in FIGS. 3 to 5, and a side 23, joining said top and bottom parts (FIGS. 3 to 5). The top part 19 of the housing 18 has a top hole 24 (FIGS. 1 and 3 to 5) formed therethrough. The top hole 24 has a diameter sufficiently greater than the diameter of the rod 7 to accommodate said rod loosely. This permits the rod 7 to "float" and thereby prevents said rod from transferring the shock of impact of the closing door 1 to the housing 18. The bottom part 20 of the housing 18 has a bottom hole 25 formed therethrough (FIGS. 1 and 3 to 5). The top and bottom holes 24 and 25 pivotally accommodate the rod 7 with the first end 8 of said rod passing through the bottom hole 25 (FIGS. 3 and 4). The area of the end 12 of the linear part 10 adjacent the bent area of the rod 7 passes through the top hole 24 (FIGS. 3 and 4). Most of the linear part 10 of the rod 7 is in the housing 18 and the bent area of said rod is outside of said housing (FIGS. 1 to 4).

The top hole 24 is spaced a predetermined distance L1 from the leading surface **5*b* of the frame 2, as shown in FIG. 4, when the housing 18 is affixed to said leading surface, and is spaced said predetermined distance from the leading surface 4 of the door 1, when said housing is affixed to said leading surface of said door. The bottom hole 25 is spaced a distance L2, which is approximately one and one half times the distance L1, from the leading surface 5*b* of the frame 2 (FIG. 4), when the housing 18 is affixed to said leading surface, and is spaced the distance L2 from the leading surface 4 of the door 1**, when said housing is affixed to said leading surface of said door.

A bushing 26 (FIGS. 1 to 5) is positioned coaxially in the bottom hole 25, as shown in FIGS. 1 to 5. The bushing 26 is coaxially affixed to the first end 8 of the rod 7 and is rotatable with said rod. The bushing 26 is used to manually rotate the rod 7 to return the ball 6 from its operative position between leading edges 3 and **5*a* of the door 1 and the frame 2, respectively, as shown in FIGS. 1 to 3, to its inoperative position in abutment with the leading surface 5*b* of said frame, as shown in FIG. 4**.

The bushing 26 has a finger accommodating portion or knurled knob part **26*a* (FIGS. 1 to 5) outside the housing 18. The knob part 26*a* of the bushing 26 has a diameter greater than that of the bottom hole 25 and is used for manual rotation of said bushing and the rod 7 and the ball 6. The bushing 26 also has a securing ring portion 26*b* (FIGS. 1 to 5), of greater diameter than the bottom hole 25, inside the housing 18 for retaining the rod 7 in position in said housing. The securing ring portion 26*b* prevents the bushing 26 and the rod 7 from axial movement more than a predetermined tolerance. The diameter of the bottom hole 25 is sufficiently greater than the diameter of the bushing 26 between its finger accommodating portion or knob part 26*a* and its securing ring portion 26*b*** to accommodate said bushing loosely.

In accordance with the invention, a deactivation preventing device (FIGS. 3 to 5) limits the extent of manual movememt of the ball 6 away from the leading edges 3 and **5*a* of the door 1 and the frame 2, respectively. This prevents the positioning of the ball 6 at a point from which the gravitational force on said ball moves said ball to the leading surface 4 of the door 1 or the leading surface 5*b* of the frame 2, rather than between the leading edges 3 and 5*a* of said door and said frame, respectively. As shown in FIGS. 3 to 5, the deactivation preventing device of the sliding door safety device is mounted in the housing 18**.

The deactivation preventing device of the invention comprises a first lug 27 extending from the ring portion **26*b* of the bushing 26, as shown in FIGS. 3 to 5, and rotatable therewith. The first lug 27 extends from the ring portion 26*b* in spaced parallel relation with the rod 7 and toward the top part 19 of the housing 18. The deactivation preventing device further comprises a second lug 28 (FIGS. 3 to 5) in the housing 18, extending from the side 23 thereof, in operative proximity with the first lug 27. The first lug 27 abuts the second lug 28 upon manual rotation of the rod 7, via the knob portion 26*a* of the bushing 26, a predetermined rotary angular extent, to prevent further rotation of said rod. This prevents positioning of the ball 6 at a point from which the gravitational force on said ball moves said ball to the leading surface 4 of the door 1 or the leading surface 5*b* of the frame 2, rather than between the leading edges 3 and 5*a*** of said door and said frame, respectively.

If the ball 6 were manually moved so that it rests on the leading surface **5*b* of the frame 2, in FIGS. 1 and 4, the sliding door safety device would be deactivated, since gravitational force would be unable to rotate the rod 7 more than 180°, as required to interpose said ball between the leading edges 3 and 5*a* of the door 1 and said frame. The same deactivation of the sliding door safety device would result if the ball 6 were manually moved so that it rests on the leading surface 4 of the door 1, in FIG. 2. The deactivation preventing device of the invention prevents the rod 7 from rotating less than 100° from the leading surface 5*b* of the frame 2 and from the leading surface 4 of the door 1. This prevents deactivation of the sliding door safety device, since it keeps the ball 6 in a position wherein the gravitational force will always move it into position between the leading edges 3 and 5*a* of the door 1 and the frame 2, respectively, as shown in FIGS. 1, 2 and 3**.

FIG. 5 shows an embodiment of the housing 18 of the sliding door safety device of the invention. In the embodiment of FIG. 5, the housing 18 consists of identical halves 29 and 30, releasably clamped to each other by small projections (not shown in the FIGS.) so that all the parts of each half are juxtaposed with those of the other.

While the invention has been described by means of a specific example and in a specific embodiment, I do not wish to be limited thereto, for obvious modifications will occur to those skilled in the art without departing from the spirit and scope of the invention.

I claim:

1. A sliding door safety device for a sliding door slidably mounted in a door frame having a track slidably accommodating the door, said door having a leading edge which abuts the frame when the door is closed and a leading surface in the area of the leading edge, said frame having a leading surface which is next-adjacent the leading surface of the door when the door is closed, said sliding door safety device comprising a resilient ball;

support means pivotally supporting the resilient ball on one of the leading surface of the door and the leading surface of the frame in a manner whereby the gravitational force on said ball moves said ball between the door and the frame, said ball being manually movable away from said door and said frame, so that said ball is positioned by gravitational force in abutment with the leading surface of one of said frame and said door when said door is closed thereby permitting said door to be securely closed with its leading edge in abutment with said frame, and is interposed by gravitational force between said leading edge of said door and said frame when said door is open thereby preventing the door from closing fully by preventing said leading edge of said door from abutting said frame and thus protecting hands from being crushed between said door and said frame, said support means comprising a rod of predetermined diameter having a linear part and spaced opposite first and second ends, said linear part of said rod extending for most of its length from the first end and being bent in the area of its second end in a manner whereby said second end is spaced at a substantially radial distance from said linear part, said ball being mounted on the second end of said rod, and mounting means pivotally mounting said rod at an acute angle with one of said leading surface of said door and said leading surface of said frame in a manner whereby said ball is rotatable in an operating plane perpendicular to said linear part and at an acute angle with one of said leading surface of said door and said frame, said mounting means comprising a housing affixed to one of said leading surface of said door and said leading surface of said frame, said housing having spaced substantially parallel top and bottom parts extending in planes spaced below and substantially parallel to the operating plane, said top part having a top hole formed therethrough and said bottom part having a bottom hole of predetermined diameter formed therethrough, said top and bottom holes pivotally accommodating said rod with the first end of said rod passing through said bottom hole and the area of the end of said linear part adjacent the bent area of said rod passing through said top hole and most of said linear part of said rod being in said housing and the bent area of said rod being outside of said housing, the first end of said rod being outside said housing, and deactivation preventing means mounted in said housing for limiting the extent of manual movement of said ball away from said leading edges of said door and said frame to prevent positioning of said ball at a point from which the gravitational force on said ball moves said ball to one of the leading surface of said door and the leading surface of said frame, rather than between said leading edges of said door and said frame; and a bushing in said bottom hole affixed to said first end of said rod and rotatable therewith for manually rotating said rod to return said ball from a position between said door and said frame to a position at the leading edge of one of said frame and said door, said bushing having a finger accommodating portion outside said housing of greater diameter than that of said bottom hole and a securing ring portion inside said housing of greater diameter than that of said bottom hole for retaining said rod in position in said housing, said deactivation preventing means comprising a first lug extending from said ring portion of said bushing and rotatable therewith and a second lug in said housing in operative proximity with said first lug, said first lug abutting said second lug upon manual rotation of said rod a predetermined rotary angular extent to prevent further rotation of said rod and thereby preventing positioning of said ball at at point from which the gravitational force on said ball moves said ball to one of the leading surface of said door and the leading surface of said frame, rather than between said leading edges of said door and said frame.

2. A sliding door safety device as claimed in claim 1, wherein the finger accommodating portion of said bushing consists of a knurled knob part for manual rotation of said bushing and said rod and ball and said securing ring portion prevents said bushing and said rod from axial movement more than a predetermined tolerance.

3. A sliding door safety device as claimed in claim 1, wherein said housing has a side joining the top and bottom parts thereof and said second lug of said deactivation preventing means extends from said side.

4. A sliding door safety device as claimed in claim 3, wherein said first lug of said deactivation preventing means extends from said securing ring portion in spaced parallel relation with said rod and toward the top part of said housing.

5. A sliding door safety device as claimed in claim 4, wherein said top hole has a diameter sufficiently greater than the diameter of said rod to accommodate said rod loosely and said bottom hole has a diameter sufficiently greater than the diameter of said bushing between its finger accommodating portion and its securing ring portion to accommodate said bushing loosely.

* * * * *